United States Patent [19]

Arakawa et al.

[11] 4,091,248

[45] May 23, 1978

[54] VACUUM-TYPE CIRCUIT BREAKER

[75] Inventors: Hideo Arakawa; Keiichi Kuniya, both of Hitachi, Japan

[73] Assignee: Hitachi, Ltd., Japan

[21] Appl. No.: 589,673

[22] Filed: Jun. 24, 1975

[51] Int. Cl.[2] ..... H01H 33/66

[52] U.S. Cl. ..... 200/144 B; 200/265; 200/266

[58] Field of Search ..... 200/144 B, 265, 266

[56] References Cited

U.S. PATENT DOCUMENTS

| | | | |
|---|---|---|---|
| 2,975,256 | 3/1961 | Lee et al. | 200/144 B |
| 3,502,465 | 3/1970 | Nakajima | 200/144 B |

FOREIGN PATENT DOCUMENTS

| | | | |
|---|---|---|---|
| 1,511,781 | 12/1967 | France | 200/144 B |

*Primary Examiner*—Robert S. Macon

*Attorney, Agent, or Firm*—Craig & Antonelli

[57] ABSTRACT

In a vacuum-type circuit breaker, a contact is composed of a principal component material of Cu alloy, to which a Pb-Bi alloy, containing either 18 to 45 weight % Bi or 65 to 80 weight % Bi and at least one of either cobalt or iron are added. Said contact is provided with a structure in which at least one of either cobalt phase or iron phase is dispersed in a copper matrix and Pb-Bi alloy phase is dispersed in the grain boundary, and has extremely low chopping current.

7 Claims, 7 Drawing Figures

VACUUM-TYPE CIRCUIT BREAKER

BACKGROUND OF THE INVENTION

The present invention relates to a vacuum-type circuit breaker, and more particularly, to a construction of the contacts of a circuit breaker of that type.

A phenomenon may occur in a vacuum-type circuit breaker such that an arc for circuit breaking becomes unstable and the electric current suddenly disappears before the natural current zero during repeated interruptions of the electric current. This is the chopping phenomenon, and if such the chopping current is high, then a surge voltage is caused at the load side, thereby presenting a great threat of electrical breakdown of the load. Chopping phenomenon never occurs when the current is satisfactorily flowing between the contacts, but if the current flow is reduced, the chopping phenomenon occurs. In other words, while current flow is satisfactory between the contacts, metallic vaporization takes place vigorously with a result that the arc is maintained stable. However, if the current flow is reduced, the volume of metallic vaporization is decreased, and the arc becomes unstable, thus resulting in an occurrence of the chopping phenomenon. A vacuum-type circuit breaker has a high arc-extinguishing capacity in vacuum, and hence, the chopping phenomenon is usually unavoidable. Consequently, it is an important factor on how to reduce chopping current. In order to do this, it is required to improve the properties of material forming the contacts. A contact should be provided with excellent electric and thermal conductivities. Hence, it is necessary to add a material having a high vapor pressure to said material of excellent electric and thermal conductivities in order to reduce the chopping current. Furthermore, the material to be added may preferably have a lower melting point than the principal component material of excellent electric and thermal conductivities and, in addition, have little or no solubility in solid principal component material. A contact composed of an alloy provided with the required properties as described above has a structure of the principal component material dispersed with the added material, and maintains the arc in a stable condition by vaporization of the added material at the time of interruption of the current. The typical alloy is Cu-Bi alloy or Cu-Pb alloy. However, in the use of said alloys, the chopping current has not been so low that electric breakdown of the load can be fully prevented.

In view of the above, we have been engaged in a development of a novel alloy to replace the Cu-Bi alloy or Cu-Pb alloy, and have discovered that when an alloy of the principal component material of copper to which a Bi-Pb alloy is added is used, the chopping current is low at the initial stage of interruption of the current. However, it has been found that in the use of this newly developed alloy, if the number of times of interruption becomes large, the chopping current goes up extremely high.

SUMMARY OF THE INVENTION

Accordingly, it is a main object of the present invention to provide a vacuum-type circuit breaker provided with contacts which have a low chopping current even if the number of times of interruption of the current is increased. More particularly, even if the number of times of interruption of the current is increased, the chopping current is made low by improving an alloy of the principal component material of copper to which Bi-Pb alloy is added.

It is another object of the present invention to provide an alloy which is within the most suitable range of composition as the contacts of a vacuum-type circuit breaker.

In the vacuum-type circuit breaker, the contact has a principal component material of Cu alloy, to which Pb-Bi alloy and at least one of either cobalt or iron is added .

Said Pb-Bi alloy can be selected among alloys containing 18 to 45 weight % Bi and 65 to 80 weight % Bi.

With the above components, the vacuum-type circuit breaker of the present invention can make the chopping current extremely low at the initial stage of interruption of the current and, even if the number of times of interruptions of current becomes large, the chopping current shows little increase. Additionally, the chopping current at the initial stage of interruption of the current has a low value as compared with the circuit breaker in which only Pb-Bi alloy is added to copper. The following is the reason why chopping the current becomes so low at the initial stage of interruption of the current. That is, the contact is subjected to soldering and degassing when the vacuum bulb is produced. Since Pb-Bi alloy is dispersed in the grain boundary of copper matrix of the contact to which Pb-Bi alloy is added, chopping current will be made due to the fact that said Pb-Bi alloy is oozed to the outer surface of the contact vaporized. However, if cobalt or iron is not added, the grain size of copper matrix is increased due to the thermal influence of the aforesaid treatments and part of the Pb-Bi alloy is confined in the grains, thereby weakening the action of oozing. On the other hand, if at least one of either cobalt or iron is added, the grain size of the copper matrix will not be increased, with the result that the Pb-Bi alloy will not be confined in the grains, thus resulting in lower chopping current.

Additionally, if at least one of either cobalt or iron is added, the rate of increase of the chopping current due to repeated interruptions of the current can be made low as compared with the case where neither cobalt nor iron is added, even if the range of compositions of Pb-Bi alloy is not within that of the present invention. This is referred to the following. That is, if neither cobalt nor iron is added, the size of copper matrix grows coarse, whereas if at least one of either cobalt or iron is added the grain size of copper matrix shows little growth even if subjected to thermal influence of the arc, with a result that the chopping current shows no increase.

However, it is unexplainable why the rate of increase of the chopping current due to repeated interruptions of current becomes extremely low by adding at least one of either cobalt or iron when the quantity of bismuth is contained within the range of 18 to 45 weight % or 65 to 80 weight % in the Pb-Bi alloy. We have surveyed that even in the contact of a vacuum-type circuit breaker in which only Pb-Bi alloy is added to copper, if the Pb-Bi alloy is selected to contain from 18 to 45 weight % Bi and 65 to 80 weight % Bi, the rate of increase of chopping current due to repeated interruptions of current is low as compared with the case where the Pb-Bi alloy which is not within the ranges of composition described above is added. However, it is unexplainable as to why the chopping current becomes extremely low when at least one of either cobalt or iron is added further.

Cu alloy composing the contact is molded in a metal mold, after having been molten. Vacuum melting is preferable in order to minimize the content of gas contained in the alloy. Additionally, the Pb-Bi alloy is preferably prepared in advance by melting an alloy according to the predetermined composition. In the course of solidification after molding, cobalt and iron are crystallized as the primary crystals, with the result that the grain size of copper is made finer. Also, grain growth of copper matrix is suppressed by virtue of the existence of primary crystals. Since Pb-Bi alloy is almost insoluble in copper and has a low melting point, it is dispersed in the grain boundary of copper matrix. Cobalt and iron prove to be effective even if added in very small quantities. However, 2 weight % or more of these materials may preferably be added. The increase of the chopping current becomes clearly suppressed if 2 weight % or more is added. If 2 weight % or more is added, grains of copper matrix become finer, and moreover, the existence of cobalt phase or iron phase having precipitated or crystallized can be recognized. Cobalt and iron are added separately or compositely, and when added compositely the Co-Fe alloy phase is produced. Even in this case, it is still advantageous in preventing grain growth of the copper matrix. On the one hand, iron and cobalt have the advantage of improving breakdown strength which has been widely known. Because of this, the addition of iron or cobalt results in improved breakdown strength. On the other hand, however, the addition of iron or cobalt makes solving difficult, and if iron or cobalt gains the greater part, it becomes difficult to obtain an alloy of uniform composition. In view of the above, it is necessary that at least one of either cobalt or iron should be contained at less than 50 weight %. As viewed from other characteristics required for a vacuum-type circuit breaker such as interrupting capacity and resistance to welding, 40 weight % or less of iron or cobalt may preferably be included. Among the cobalt and iron, cobalt may be preferably added because an alloy containing cobalt can be produced easier and cobalt has superior electric conductivity.

Quantity of Pb-Bi alloy overall must be within the range of 0.1 to 20 weight %. If less than 0.1 weight % Pb-Bi alloy is included, the quantity of the alloy oozing to the surface is limited and the arc can not be maintained stable, and hence, the chopping current can not be made low. If more than 20 weight % Pb-Bi alloy is provided, lead and bismuth are vaporized in large quantities in the case of degassing of the container, thereby dirtying various parts in the container. For the purpose of providing high resistance to welding, 0.5 to 10 weight % is preferable. Whether the chopping current is high or low depends on not only the added quantity of Pb-Bi alloy, but also the composition of Pb-Bi alloy. More particularly, either an alloy containing 18 to 45 weight % Bi or an alloy containing 65 to 80 weight % Bi presents an excellent effect. If the composition of the Pb-Bi alloy deviates even slightly from the above ranges of composition, the chopping current sharply goes up. Among the 18 to 45 weight % Bi alloy and the 65 to 80 weight % Bi alloy, the former is more effective.

Further, it has been generally known that adding extremely small quantities of boron and metals such as titanium, chrominum, tungsten, zirconium, silver and hafnium to the Cu alloy makes the grain size finer and prevents grain growth.

In view of the above, we have actually added the above metals in quantities of usual addition to Cu alloy containing the Pb-Bi alloy and tried to ascertain the effect by heating the alloy obtained, up to 900° C. However, all of the results were unsuccessful and we could not attain the existence of Pb-Bi alloy phase in the grain boundary of the copper matrix.

Figure 1:
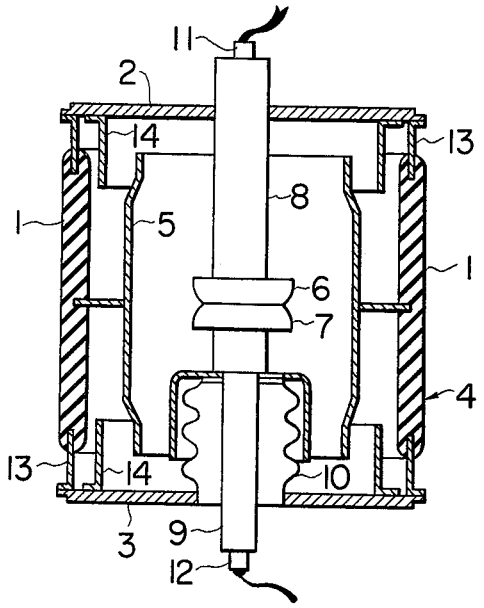
FIG. 1 is a cross-sectional view of the vacuum-type circuit breaker.

For example, a vacuum-type circuit breaker has a construction shown in FIG. 1. Now description will be given. This circuit breaker has a container 4 comprising a case 1 made of electrically insulating material and a pair of metal end caps 2 and 3 for closing both ends of said case 1. The pressure within the container 4 is maintained generally lower than $10^{-4}$ Torr and preferably within the range of $10^{-5}$ to $10^{-8}$ Torr in non-operating and reposing condition of the circuit breaker. The inner wall surface of the case 1 is covered by a shield tube 5 properly supported by the case 1 for preventing metal vapor generated by the arc from adhering to and solidifying on the inner wall surface of the case 1. Said shield tube 5 is adapted to shield the case 1 from the vapor generated by the arc before the vapor reaches the case 1.

A pair of electrodes or contacts, i.e., an upper contact 6 and a lower contact 7, are provided in the container 4.

The upper contact 6 is fixedly secured to a stationary conductive bar 8 which in turn is fixedly mounted on the metal end cap 2. The lower contact 7 is mounted on a movable conductive bar 9 so as to be movable.

The movable conductive bar 9 penetrates through an opening provided in the metal end cap 3. A metal bellows 10 is provided circumferentially around the movable conductive bar 9. The metal bellows 10 is adapted to permit the movable conductive bar 9 to move longitudinally without breaking vacuum in the container 4. A suitable actuating device (not shown) is provided beneath the movable conductive bar 9 for opening the circuit breaker by downwardly moving the lower contact 7 to move from the upper contact 6, and closing the circuit breaker by returning the lower contact 7 to the position shown in the drawing.

Further, terminals designated at 11 and 12 are provided to connect the circuit breaker to an A.C. power circuit. The upper terminal 11 is connected to the upper contact 6 through the stationary conductive bar 8. The lower terminal 12 is connected to the lower contact 17 through the movable conductive bar. When the circuit breaker is closed as shown in FIG. 1, current flows between the terminals through the upper and lower contacts.

The case 1 made of insulating material and the metal end caps 2 and 3 are jointed generally by inert gas-tungsten arc welding or soldering.

However, the case 1 is generally made of ceramic or glass, and the metal end caps 2 and 3 are made of copper. Consequently, if both are directly jointed, cracking may be caused to the case 1 due to excessively large difference in coefficient of thermal expansion between the case and the metal end caps.

Accordingly, fittings 13 made of a material having a coefficient of thermal expansion between those of the case 1 and the metal end caps 2 and 3 are buried into both ends of the case 1, and the fittings 13 are jointed to the metal end caps 2 and 3.

When the case 1 is made of glass and the metal end caps 2 and 3 are made of copper, the fittings 13 are generally made of Fernico.

Usually metal vapor generated by the arc is shielded before reaching the inner wall surface of the case 1. However, part of the vaporized metal having escaped from shielding, passes through an aperture formed between the end of the shield tube 5 and the metal end caps 2 and 3, enters the rear side of the shield tube 5, and may adhere to the inner wall surface of the case 1. To prevent this, end shield tubes 14 are provided in the intermediate positions between the case 1 and the shield tube 5 in most cases.

The opposing upper contact 6 and the lower contact 7 are each composed of the alloy containing 0.1 to 20 weight % of a Pb-Bi alloy, containing either 18 to 45 weight % Bi or 65 to 80 weight % Bi, and further less than 50 weight % of at least one of either cobalt or iron, in copper. The upper contact 6 is secured to the stationary conductive bar 8 by soldering. The lower contact 7 is secured to the movable conductive bar 9 by soldering. Soldering described herein is usually carried out at the temperature of 600° C or higher. After the installation of parts is completed, degassing is carried out to remove gases adhering to the inner wall surface of the case and various parts in the container. Said degassing is performed usually at the temperature of about 400° C. An alloy contact in which only the Pb-Bi alloy is added and neither cobalt nor iron is added to copper shows a great grain size of copper matrix when subjected to soldering and degassing, and the Pb-Bi alloy phase is confined within grains the matrix, whereas according to the present invention there is almost no grain growth of copper matrix, because at least one of either cobalt or iron is added.

Figure 2:
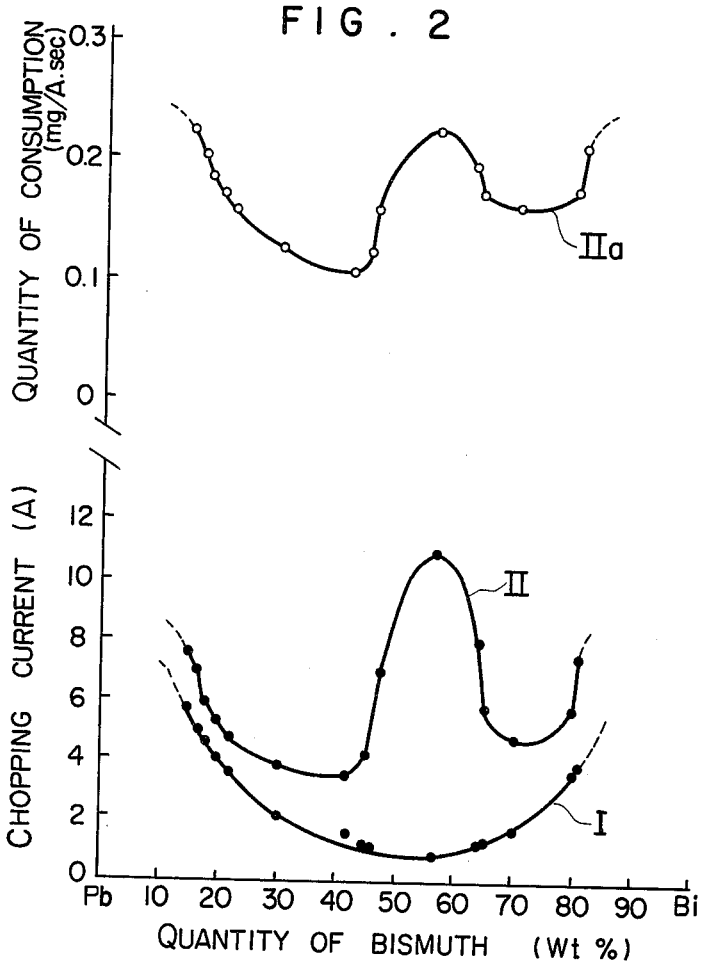
FIG. 2 is a characteristic curve diagram showing the conditions in which both the chopping current value and the quantity of consumption of the vacuum-type circuit breaker having the contacts composed of an alloy material containing Pb-Bi alloy in copper are varied in accordance with various composition between lead and bismuth.

FIG. 2 illustrates the chopping current of the vacuum-type circuit breaker having the contacts composed of an alloy in which only Pb-Bi alloy is added to copper and neither cobalt nor iron is added. The contacts require not only a low chopping current, but also a low consumption rate. On the one hand, increase in quantity of consumption should be taken into account if the vaporization of metal takes place. Hence, quantity of consumption has been shown in FIG. 2. These characteristics were obtained through current interruption tests conducted on the contacts incorporated in the assembly-type bulbs and not subjected to treatments such as degassing and soldering. Quantity of Pb-Bi alloy is 5.5 weight %. As for the composition of Pb-Bi alloys, the quantities of bismuth contained are each 15, 17, 18, 20, 22, 30, 42, 45, 46, 56.5, 64, 65, 70, 80 and 81 weight %. Measurements of the chopping current have been made twice, i.e., after the current of 5 to 15 Amperes is interrupted once and after current of 5 to 15 Amperes is interrupted 12 times. The chopping current measured after one time interruption of current is designated by 'I' and the chopping current measured after twelve times of interruption of current by 'II' in the drawing. Quantity of consumption was measured after twelve times interruption of current and is designated by 'II*a*' in the drawing.

With Cu alloy contact containing 5 weight % of Pb-Bi alloy, the value of the chopping current varies between the cases of one time interruption of current (I) and twelve times of interruption of current (II) as shown in the drawing. The value of the chopping current after one time interruption of current is lowest with the contact containing a Pb-Bi eutectic alloy comprising 56.5 weight % Bi.

However, with the contact of said alloy, the chopping current is greatly increased as the number of times of interruption of current is increased. The rate of increase of the chopping current is particularly great with the contact containing Pb-Bi eutectic alloy comprising 56.5 weight % Bi. With the contact containing 18 to 45 weight % Bi or 65 to 80 weight % Bi, the rate of increase of the chopping current is relatively small, for which the reason is unknown. Also, the quantity of consumption is largest with the contact containing Pb-Bi eutectic alloy. With the contact formed of a Pb-Bi alloy containing 18 to 45 weight % Bi or 65 to 80 weight % Bi, quantity of consumption is relatively small.

Figure 3A:
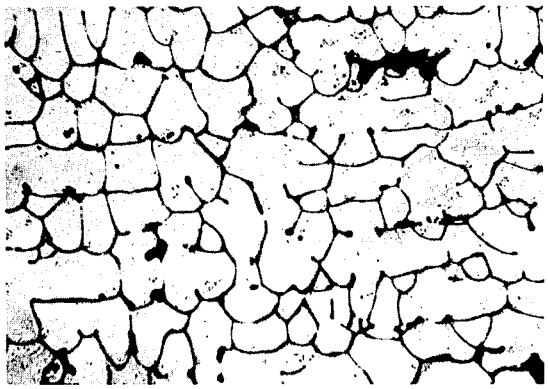
FIGS. 3*a* and 3*b* are photographs illustrating the micro-structures, as is molded and as is heated respectively, of the alloy contact containing Pb-Bi alloy in copper.
Figure 3B:
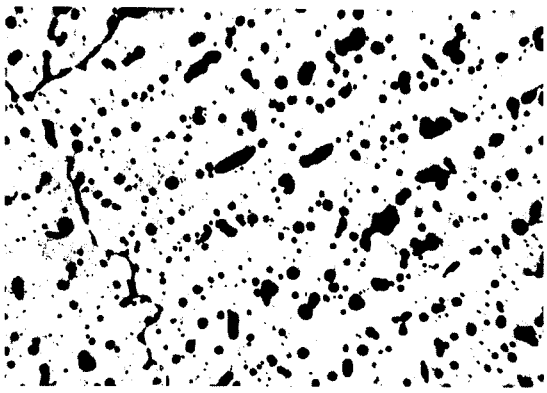

FIGS. 3*a* and 3*b* are photographs illustrating the micro-structures of the Cu alloy contact including a Pb-Bi alloy containing 5.5 weight % of Pb-42 weight % Bi.

FIG. 3*a* shows the contact as is molded. FIG. 3*b* shows the contact heated in $H_2$ at 800 to 880° C for 1 hour and then again heated under $5 \times 10^{-5}$ Torr at 400° to 450° C for 20 hours on the supposition of heat treatments to which the contact would be subjected after incorporated in the vacuum-type circuit breaker. Both FIGS. 3*a* and 3*b* are magnified 100 times. As shown in FIG. 3*a*, the contact as is molded has a structure in which Pb-Bi alloy phase (black portions) is intervened in a chain-like shape in the grain boundary of the copper matrix. However, if the contact is subjected to heat treatment, as shown in FIG. 3*b*, Pb-Bi alloy phase is confined in the grains of the copper matrix as in a nearly spherical shape. The above contacts have been subjected to the tests of interruption of the current under the same condition as in the first example. The results were that the chopping current of the alloy having the structure shown in FIG. 3*a* was 1.7A, while that of the alloy having the structure shown in FIG. 3*b* was 6A which is about three times the value of the former.

Description will be given on an example of tests conducted on the alloy contacts in which Pb-Bi alloy and cobalt are added to copper.

EXAMPLE 1

Alloys have been produced, each of which contains 7 weight % of Pb-Bi alloy, 20 weight % of cobalt, the balance being copper. The process of production included the steps of: subjecting oxygen free copper and cobalt to vacuum melting in an atmosphere of $5 \times 10^{-5}$ Torr; ascertaining that both have melted into each other; switching the atmosphere to argon; adding thereto Pb-Bi alloy prepared in advance by vacuum melting; and making same to solidify in a metal mold. Then, test pieces of 30 mm in the outer diameter and 20 mm in the thickness for use in tests of interruption of current have been obtained from the ingot thus produced.

On the supposition of heat treatments to which the contact would be sujected after incorporated in the vacuum-type circuit breaker, the contact is heated in $H_2$ at 800° to 880° C for one hour and then again heated in a vacuum of $5 \times 10^{-5}$ Torr at 400° to 450° C for 20 hours. Then, after the contact is incorporated in an assembly-type bulb tests of interruption of current of 5 to 15A were conducted. The number of alloys subjected to the tests was 15 Pb-Bi alloys each containing Bi of 15, 17, 18, 20, 22, 30, 42, 45, 46, 56.5, 64, 65, 70, 80 and 81 weight %.

Figure 4:
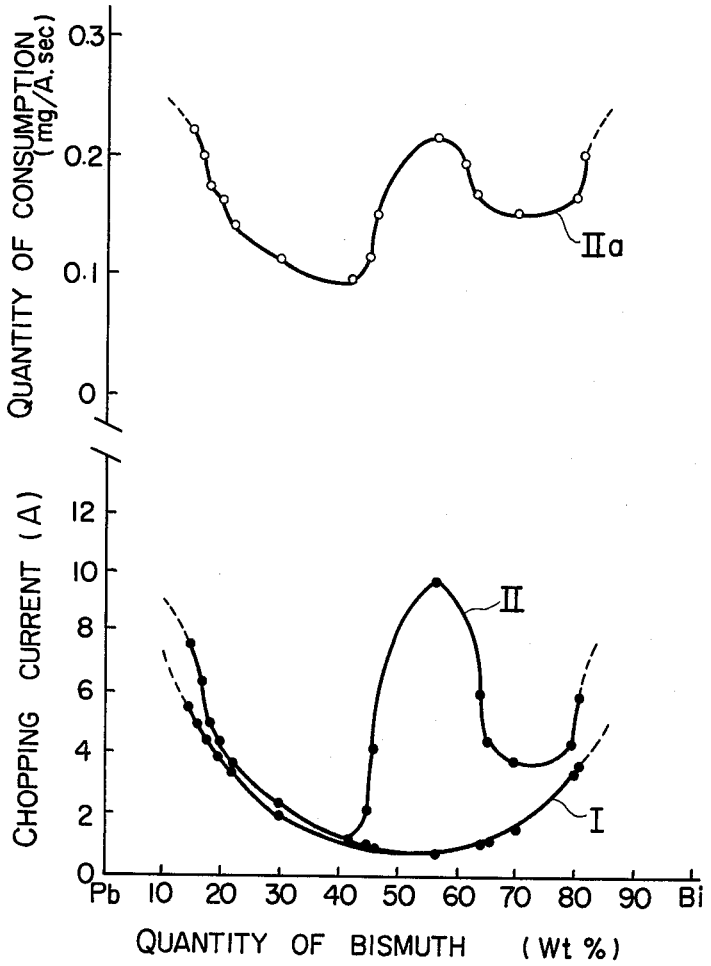
FIG. 4 is a characteristic curve diagram showing the conditions in which both the chopping current value and the quantity of consumption of the vacuum-type circuit breaker having the contacts composed of an alloy containing Pb-Bi alloy and cobalt in copper are varied in accordance with various composition between lead and bismuth.

The chopping current and the quantity of consumption are shown in FIG. 4. Measurements of the chopping current have been made twice, i.e., after current is interrupted once and after the current is interrupted 12 times. The chopping current measured after one time interruption of current is designated by 'I' and the chopping current measured after twelve time interruptions of current by 'II' in the drawing. The quantity of consumption was measured after twelve times of interruptions of current and is designated by 'II*a*' in the drawing.

When cobalt is added to the composition, the chopping current is slightly decreased after one time interruption of current as compared with the case where no cobalt is added. However, this difference is extremely small. One of the characteristics of cobalt is to prevent the grain growth of the copper matrix when it is heated, to allow the Pb-Bi alloy oozing from the grain boundary, and the other lies in that even if interruptions of current are repeated the chopping current will not be greatly increased for the Pb-Bi alloys which are within the specific ranges of composition.

More particularly, for Pb-Bi alloys containing 18 to 45 weight % Bi or 65 to 80 weight % Bi, the chopping current shows little increase when interruptions of current are repeated. For Pb-Bi alloy containing Bi of up to 42 weight %, the chopping current after repeated interruptions of current decreases with increase of Bi in quantity. Thus, if Bi in quantity exceeds 42 weight %, the chopping current increases with increase of Bi in quantity until the quantity of Bi reaches the peak of 56.5 weight %. If the quantity of Bi exceeds the peak, the chopping current again decreases with increase of Bi in quantity until the quantity of Bi reaches 70 weight %. Thereafter, the chopping current again increases with the increase of Bi in quantity. There are considerably large differences in the measured chopping current between the Pb-Bi alloys containing 17 weight % Bi and 18 weight % Bi and also between the Pb-Bi alloys containing 45 weight % Bi and 46 weight % Bi. Likewise, there are considerably large differences in the measured chopping current between Pb-Bi alloys containing 64 weight % Bi and 65 weight % Bi and also between 80 weight % Bi and 81 weight % Bi. A stable and low chopping current is measured for Pb-Bi alloys containing 22 to 42 weight % Bi among those containing from Pb-18 to 45 weight % Bi.

The tendency of increase and decrease in quantity of consumption is substantially the same as that of the chopping current, and the quantity of consumption is least for the Pb-Bi alloys containing 18 to 45 weight % Bi and 65 to 80 weight % Bi.

EXAMPLE 2

Seven alloys have been produced, each of which contains 5.5 weight % of Pb-42 weight % Bi alloy, 0 to 20 weight % of cobalt, the balance being copper. The process of production included the steps of: subjecting oxygen free copper and cobalt to vacuum melting in an atmosphere of $5 \times 10^{-5}$ Torr; ascertaining that both have melted into each other; switching the atmosphere to argon; adding thereto a Pb-Bi alloy including 42 weight % Bi prepared in advance by vacuum melting; and making same to solidify in a metal mold of 100 mm in outer diameter, 60 mm in inner diameter and 60 mm in height. Then, test pieces of 30 mm in the outer diameter and 20 mm in the thickness for use in tests of interruption of current have been obtained from the ingot thus produced.

The test pieces were subjected to a more severe heating condition than would normally occur at the time of manufacturing a circuit breaker, more particularly, they were heated in a vacuum of $2 \times 10^{-5}$ Torr at 900° C for 1 hour, and inspected for change in the structure by using an optional microscope. The results are shown in the following table.

Table

| Quantity of cobalt (weight %) | Change in structure after heating |
|---|---|
| 0 | Yes |
| 0.5 | Yes |
| 1.0 | Yes |
| 2.0 | No |
| 3.0 | No |
| 4.0 | No |
| 5.0 | No |
| 20.0 | No |

With the alloy containing 0 weight % of cobalt, copper grains of matrix have grown to be considerably coarse. With the alloys containing 0.5 weight % Co and 1.0 weight % Co, copper grains of matrix have grown more or less and such change in structure has been surveyed that part of the Pb-Bi alloy phase was confined in said grains. However, with the alloy containing 2 weight % Co, no change in structure has been recognized and Pb-Bi alloy phase was interposed in the grain boundary of the matrix.

Figure 5A:
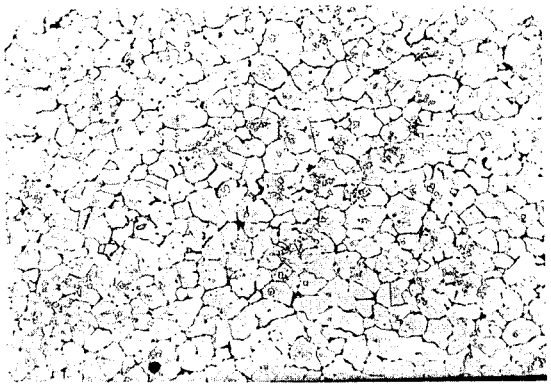
FIGS. 5*a* and 5*b* are photographs illustrating the micro-structures, as is molded and as is heated respectively, of the alloy contact containing Pb-Bi alloy and cobalt in copper.
Figure 5B:
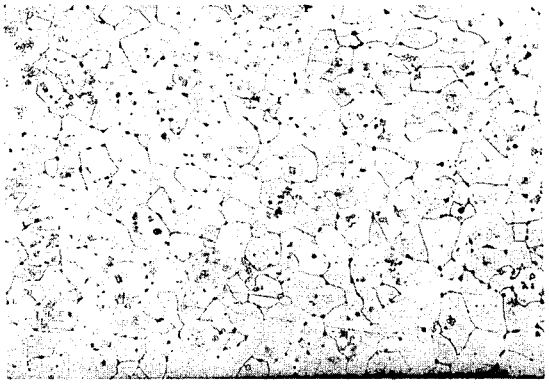

FIGS. 5*a* and 5*b* illustrate by way of example photographs of micro-structures of a copper alloy containing 5.5 weight % of Pb-Bi alloy and 5 weight % of cobalt.

FIG. 5*a* is the photograph before heating, FIG. 5*b* the photograph after heating, and both FIGS. 5*a* and 5*b* are magnified 100 times.

As is apparent from the photographs, copper grains of matrix shows little growth after heating and the Pb-Bi alloy phase is remaining in the grain boundary of the copper matrix.

EXAMPLE 3

Copper alloys are produced, each of which contains 7 weight % of Pb-Bi alloy, including 42 weight % Bi, and 5 weight % of cobalt by the same process as described in Example 2. A contact was obtained from an ingot thus produced, and incorporated in a vacuum-type circuit breaker of construction shown in FIG. 1.

Then, an upper electrode is secured to a stationary conductive bar and a lower electrode to a movable conductive bar by soldering. Soldering was carried out by inserting tin solder into joints and heating in an atmosphere of $H_2$ at 800° to 880° C.

Thereafter, degassing was carried out after heating in a vacuum of $5 \times 10^{-5}$ Torr at 400° to 450° C for 20 hours.

With the vacuum-type circuit breaker thus produced, the chopping current of the contact was approximately 1.3 A after 30 times interruption of current of 4 to 15 A and 6.3 KV.

EXAMPLE 4

A vacuum-type circuit breaker is produced which has a contact made of Cu alloy containing 5.5 weight % of a Pb-Bi alloy, including 42 weight % Bi, and 4 weight % of cobalt, by the same process as described in Example 3. With said contact, the chopping current was approximately 1.5 A after 30 times of interruption of current of 4 to 15 A and 6.3 KV.

As apparent from the examples described, with the vacuum-type circuit breaker having a contact containing Pb-Bi alloy, cobalt, the balance being copper, chopping current was as low as less than 2 A. This is approximately one-third to one-fifth of the chopping current that a contact containing no cobalt has in the substantially same condition.

EXAMPLE 5

A vacuum-type circuit breaker is produced which has a contact made of Cu alloy containing 7 weight % of a Pb-Bi alloy, including 42 weight % Bi, 10 weight % of iron, the balance being essentially copper. Conditions for production were same as that described in Example 2. Said contact is heated in $H_2$ at 800° to 880° C on the supposition of soldering work and further heated in a vacuum of $5 \times 10^{-5}$ Torr at 400° to 450° C for 20 hours on the supposition of degassing treatment. As the result, a structure was obtained, in which grains of copper matrix show little coarseness and most part of Pb-Bi alloy phase is dispersed in the grain boundary of the matrix even after heating. Further, with said contact incorporated in a vacuum-type circuit breaker of construction shown in FIG. 2, the chopping current was about 1.8 A after 30 times of interruption of the current of 4 to 15 A and 6.3 KV.

As apparent from the examples described, the vacuum-type circuit breaker produced according to the present invention has extremely low chopping current. Additionally, said chopping current shows little increase even after current is interrupted many times. Thus, it is possible to prevent electric breakdown of the load.

What is claimed is:

1. A vacuum-type circuit breaker comprising an evacuated container, a pair of contacts provided in said container, and means to open and close said contacts for circuit breaking, characterized in that said contacts are made of an alloy material containing 0.1 to 20 weight % of a Pb-Bi alloy containing either 18 to 45 weight % Bi or 65 to 80 weight % Bi, 2 to 50 weight % of at least one of either cobalt or iron, the balance being essentially copper.

2. A vacuum-type circuit breaker as defined in claim 1, characterized in that Pb-18 to 45 weight % Bi alloy is contained in the material of said contacts.

3. A vacuum-type circuit breaker as defined in claim 1, characterized in that Pb-22 to 42 weight % Bi alloy is contained in the material of said contacts.

4. A vacuum-type circuit breaker as defined in claim 1, characterized in that from 0.5 to 10 weight % of one alloy selected from Pb-18 to 45 weight % Bi alloy and Pb-65 to 80 weight % Bi alloy is contained in the material of said contacts.

5. A vacuum-type circuit breaker as defined in claim 1, characterized in that 2 to 40 weight % of at least one of either cobalt or iron is contained in the material of said contacts.

6. A vacuum-type circuit breaker as defined in claim 1, characterized in that cobalt is contained in the material of said contacts.

7. A vacuum-type circuit breaker wherein said circuit breaker comprises a container evacuated and a pair of electrodes provided in said container and adapted to open or close for circuit breaking generating an arc, characterized in that said electrodes are made of an alloy containing 0.1 to 20 weight % of Pb-22 to 42 weight % Bi alloy, 2 to 40 weight % of cobalt, the balance being essentially copper.

* * * * *

UNITED STATES PATENT AND TRADEMARK OFFICE

CERTIFICATE OF CORRECTION

PATENT NO. : 4,091,248

DATED : May 23, 1978

INVENTOR(S) : Hideo ARAKAWA et al.

It is certified that error appears in the above-identified patent and that said Letters Patent are hereby corrected as shown below:

On the Title Page, lefthand column, before "[51] Int. Cl. 2...", insert:

--[30] Foreign Application Priority Data

June 26, 1974 [JP] Japan ..... 72306--.

Signed and Sealed this

Twenty-first Day of December 1982

[SEAL]

*Attest:*

GERALD J. MOSSINGHOFF

*Attesting Officer*

*Commissioner of Patents and Trademarks*